US007527444B2

(12) United States Patent
Sawai et al.

(10) Patent No.: US 7,527,444 B2
(45) Date of Patent: May 5, 2009

(54) IMAGE FORMING DEVICE, HAVING AN INJECTION TRAY, AND A DISPLAY IS MOUNTED TO A COVER

(75) Inventors: Kunihito Sawai, Kanagawa (JP); Yutaka Hasegawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/193,084

(22) Filed: Jul. 25, 2005

(65) Prior Publication Data

US 2006/0024117 A1 Feb. 2, 2006

(30) Foreign Application Priority Data

Jul. 27, 2004 (JP) ..... 2004-218268

(51) Int. Cl.
*B41J 11/58* (2006.01)

(52) U.S. Cl. ..... 400/624; 348/375; 348/207.2

(58) Field of Classification Search ..... 348/207.2, 348/375; 400/624
See application file for complete search history.

(56) References Cited

U.S. PATENT DOCUMENTS 4,262,301 A * 4/1981 Erlichman ..... 386/31
5,392,447 A * 2/1995 Schlack et al. ..... 715/863
6,356,357 B1 * 3/2002 Anderson et al. ..... 358/1.17
6,550,910 B2 * 4/2003 Hwang ..... 347/108
6,552,743 B1 * 4/2003 Rissman ..... 348/207.2
6,609,461 B2 * 8/2003 Horii et al. ..... 101/484
2001/0030692 A1 * 10/2001 Yoneda ..... 348/207
2003/0156200 A1 * 8/2003 Romano et al. ..... 348/207.99
2004/0212822 A1 * 10/2004 Schinner ..... 358/1.15
2004/0263632 A1 * 12/2004 Kimura ..... 348/207.2
2005/0088689 A1 * 4/2005 Suga et al. ..... 358/1.15

FOREIGN PATENT DOCUMENTS

EP 0 949 804 10/1999
EP 1 182 860 2/2002
JP 08-293941 11/1996

* cited by examiner

*Primary Examiner*—Leslie J Evanisko
*Assistant Examiner*—Matthew G Marini
(74) *Attorney, Agent, or Firm*—Robert J. Depke; Rockey, Depke & Lyons, LLC.

(57) ABSTRACT

An ejection tray includes a container that contains a recording sheet printed by a printing unit of an image forming apparatus, and a cover mounted on the container. The cover has a display for displaying information, and the display displays an information screen corresponding to information that can be printed on the recording sheet.

7 Claims, 7 Drawing Sheets

IMAGE FORMING DEVICE, HAVING AN INJECTION TRAY, AND A DISPLAY IS MOUNTED TO A COVER

CROSS REFERENCES TO RELATED APPLICATIONS

The present invention contains subject matter related to Japanese Patent Application JP 2004-218268 filed in the Japanese Patent Office on Jul. 27, 2004, the entire contents of which are incorporated herein by reference.

BACKGROUND OF THE INVENTION

1. Field of the Invention

The present invention relates to an ejection tray that contains printed recording sheets in an image forming apparatus, to a sheet supply and ejection device for recording sheets in an image forming apparatus, to an image forming apparatus such as a printer, a copying machine, or a facsimile apparatus, and to an information display device that allows viewing of various information displayed on a display. More particularly, the present invention relates to a technique that allows information about an image that can be printed on a recording sheet to be displayed as an information image before an actual printing operation.

2. Description of the Related Art

In general image forming apparatuses, for example, printers, copying machines, and facsimile apparatuses, recording sheets, such as cut sheets, contained in a supply tray are sequentially conveyed to a printing unit, such as an ink-jet head, so that printing is performed thereon. After printing, the recording sheets are ejected and stocked in an ejection tray.

Print data used for printing on recording sheets is acquired from an information acquisition unit, such as a personal computer or a digital camera, via various interfaces (RS232C, SCSI, IEEE1394, and USB), and is stored in a memory. Printing is performed on the recording sheets according to the stored print data.

Japanese Unexamined Patent Application Publication No. 2000-36931 discloses a printer to which a digital camera serving as an information acquisition unit can be detachably connected. This printer includes a connecting base to which a digital camera is connected to acquire print data. Printing is performed on recording sheets according to the print data acquired by the connecting base.

According to the technique disclosed in this publication, images are displayed on a liquid crystal display provided on the back side of the digital camera. When any of the images is selected to be printed, print data on the selected image is transferred to the printer. A cut sheet (recording sheet) is then conveyed from a supply tray by supply rollers provided in the printer, and printing is performed thereon by a printing unit. After printing, the supply rollers are reversed to eject and stock the cut sheet in an ejection tray disposed on the supply tray.

SUMMARY OF THE INVENTION

However, images to be printed are displayed only on the liquid crystal display of the digital camera. That is, the digital camera is detached from the printer, there is no means for displaying the images. For this reason, it is possible to check what print data (image) is transferred to the printer and stored in the memory, only by actually printing the image.

It is desirable to provide an ejection tray, a sheet supply and ejection device, an image forming apparatus, and an information display device that allow information about an image that can be printed on a recording sheet to be displayed as an information image before an actual recording operation even when an information acquisition unit (e.g., a digital camera) for acquiring print data is not connected thereto, and that stores a recording sheet on which a desired image is printed by printing according to the information image.

In order to overcome the above problems, an ejection tray according to an embodiment of the present invention includes a container that contains a recording sheet printed by a printing unit of an image forming apparatus, and a cover mounted on the container. The cover has a display for displaying information, and the display displays an information image corresponding to information that can be printed on the recording sheet by the printing unit.

A sheet supply and ejection device according to another embodiment of the present invention includes a supply tray from which a recording sheet is supplied, and an ejection tray in which the recording sheet is ejected after being subjected to printing by a printing unit of an image forming apparatus. The ejection tray includes a container that contains the recording sheet after printing, a cover mounted on the container, and a display provided on the cover to display information. The display displays an information image corresponding to information that can be printed on the recording sheet.

An image forming apparatus according to a further embodiment of the present invention includes a printing unit for performing printing on a recording sheet, a supply tray from which the recording sheet is supplied, and an ejection tray in which the recording sheet is ejected after being subjected to printing by the printing unit. The ejection tray includes a container that contains the recording sheet after printing, a cover mounted on the container, and a display provided on the cover to display information. The display displays an information image corresponding to information that can be printed on the recording sheet.

An information display device according to a still further embodiment of the present invention includes a container that contains a recording sheet after printing, a cover mounted on the cover, and a display provided on the cover to display information for inspection. The display displays an information image corresponding to information that can be printed on the recording sheet by a printing unit of an image forming apparatus.

That is, in the above embodiments, an information image corresponding to information that can be printed on a recording sheet by the printing unit is displayed on the display. Therefore, the information can be checked before an actual printing operation, regardless of whether or not a means for acquiring print data is connected.

The above embodiments of the present invention can be finally applied to the same apparatus (image forming apparatus), regardless of the name. That is, the sheet supply and ejection device includes the ejection tray, and the image forming apparatus includes the sheet supply and ejection device, or includes the information display device and the printing unit.

Information acquired by an information acquisition unit, such as a digital camera, can be displayed on the display. In this case, the information acquisition unit may be placed on the cover or the display to display information. When an information holding unit is provided to hold information acquired by the information acquisition unit, the held information can be displayed. The display may have a touch panel function.

The recording sheet contained in the container can be taken out by opening the cover movably mounted on the container.

Alternatively, the recording sheet may be automatically ejected from an ejection port provided in the container without opening the cover.

In the ejection tray, the sheet supply and ejection device, the image forming apparatus, and the information display device according to the embodiments of the present invention, the display is provided to display information on the cover mounted on the container that contains printed recording sheets. The display displays an information image corresponding to information that can be printed on the recording sheets by the printing unit. Therefore, even when the information acquisition unit (e.g., a digital camera) is not connected, it is possible to check the printable information before an actual printing operation. By performing printing according to the displayed information image, a recording sheet on which a desired image is printed can be contained in the container.

DESCRIPTION OF THE PREFERRED EMBODIMENTS

An embodiment of the present invention will be described below with reference to the drawings.

The ejection tray, the sheet supply and ejection device, the image forming apparatus, and the information display device of the present invention are used in the same apparatus (image forming apparatus) in the following embodiment. An ink-jet printer 10 corresponding to the image forming apparatus also corresponds to the information display device, a part (a container 13 and a cover 14) of the ink-jet printer 10 corresponds to the ejection tray, and the ejection tray and a supply tray 15 correspond to the sheet supply and ejection device.

Figure 1:
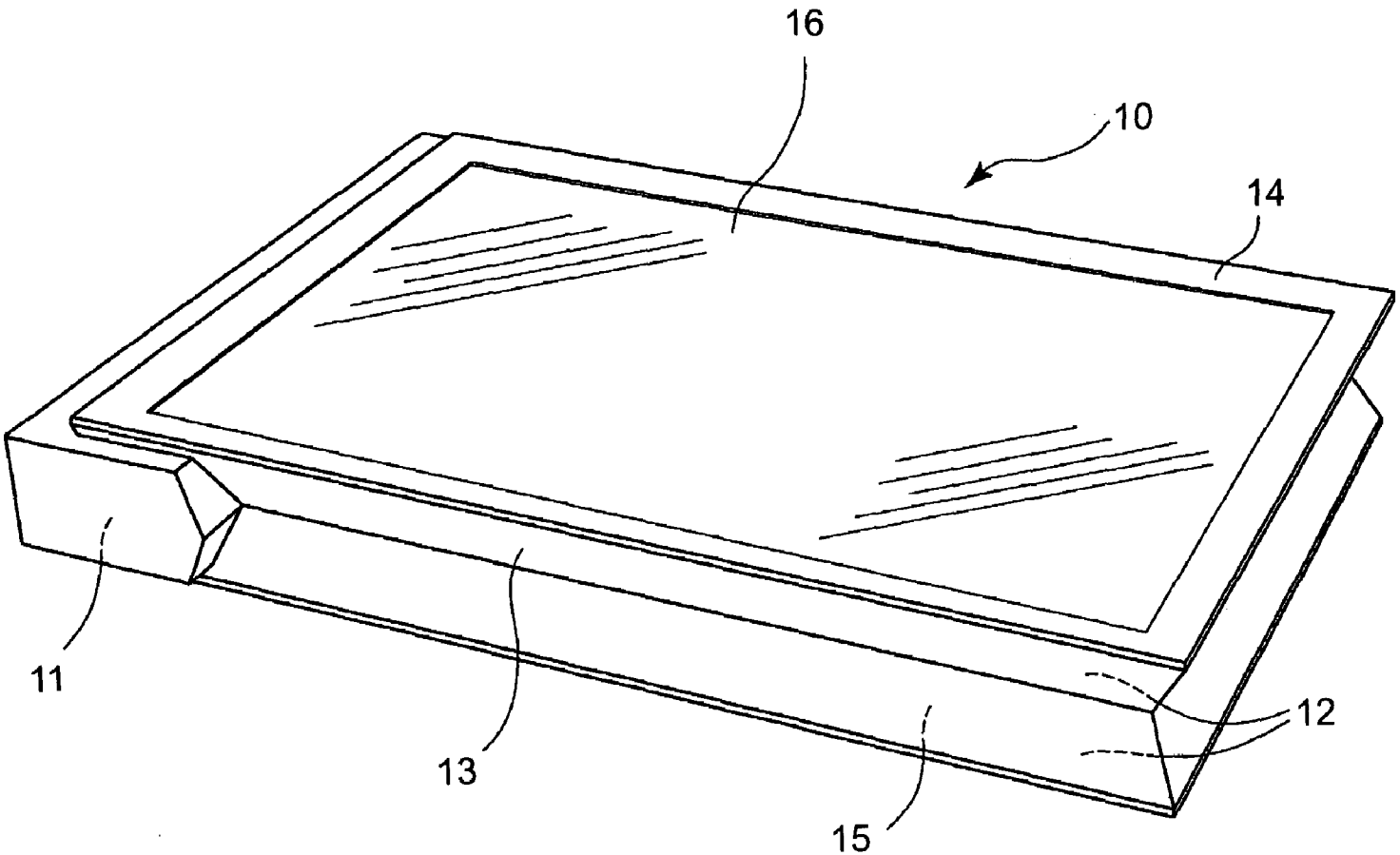
FIG. 1 is a perspective view of an ink-jet printer according to an embodiment of the present invention.

FIG. 1 is a perspective view of an ink-jet printer 10 according to this embodiment.

Referring to FIG. 1, the ink-jet printer 10 includes an ink-jet head 11 (corresponding to the printing unit), a container 13 that contains cut sheets 12 (corresponding to the recording sheets) on which printing is performed by the ink-jet head 11, a movable cover 14 mounted on the container 13, and a supply tray 15 from which the cut sheets 12 are supplied. The container 13 and the cover 14 constitute an ejection tray. A liquid crystal display 16 (corresponding to the display) is provided on the cover 14.

The ejection tray (container 13 and cover 14) is provided on the supply tray 15, and the ink-jet head 11 is provided at one end of the supply tray 15. Therefore, the ink-jet printer 10 has a planar outer shape that is one size larger than the cut sheets 12. This provides high space efficiency and excellent design.

Figure 2:
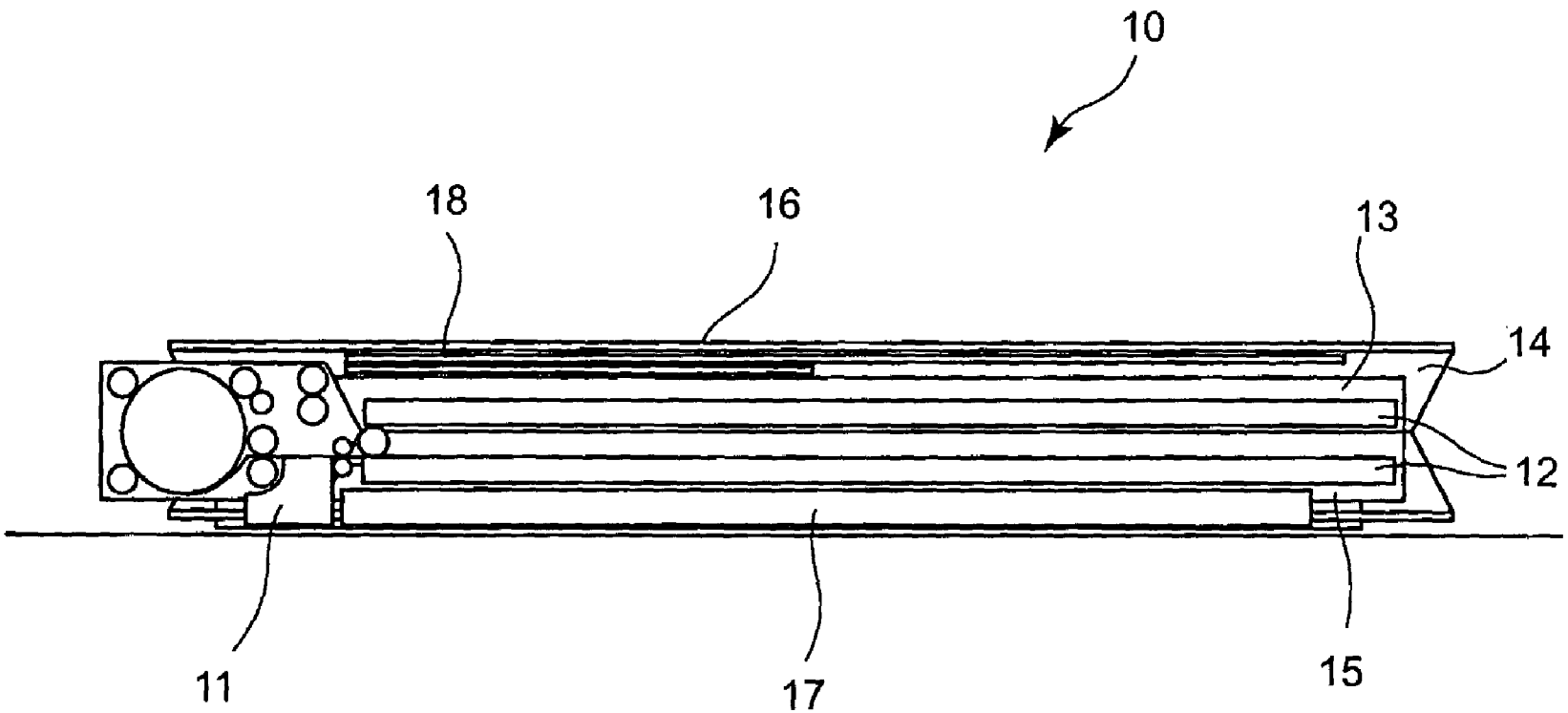
FIG. 2 is a cross-sectional view of the ink-jet printer.

FIG. 2 is a cross-sectional view of the ink-jet printer 10.

As shown in FIG. 2, cut sheets 12 are stacked in the supply tray 15. The cut sheets 12 are supplied one by one from the uppermost one while being nipped by supply rollers, and printing is performed thereon by the ink-jet head 11.

The ink-jet head 11 is a line head having a length correspondingly to the print width, and includes multiple heads arranged in the widthwise direction of the cut sheets 12. Therefore, it is possible to perform printing without moving the ink-jet head 11 in the widthwise direction of the cut sheets 12.

Inks of four colors, Y (yellow), M (magenta), C (cyan), and K (black) are supplied from an ink cartridge 17 to the ink-jet head 11 so that printing can be performed on the cut sheets 12 with quality of color pictures. The ink cartridge 17 is provided under the supply tray 15. That is, three components, the ink cartridge 17, the supply tray 15, and the ejection tray (container 13 and cover 14), are stacked.

Print data (for example, picture images) for cut sheets 12 is sent from an unshown digital camera (corresponding to the information acquisition unit), in a wireless manner, is received by a receiver mounted on a control board 18, and is stored in a memory (corresponding to the information holding unit). The control board 18 also controls the display of information on the cover 14 by the liquid crystal display 16. Various interfaces (RS232C, SCSI, IEEE1394, and USB) may be provided on the control board 18 for wire connection to the information acquisition unit.

After printing is performed on a cut sheet 12 by the ink-jet head 11 according to the print data stored in the memory, the cut sheet 12 is ejected in a bent form by an ejection roller, and is placed in the container 13 with its print surface facing up. Subsequently printed cut sheets 12 are stacked in the container 13.

Figure 3:
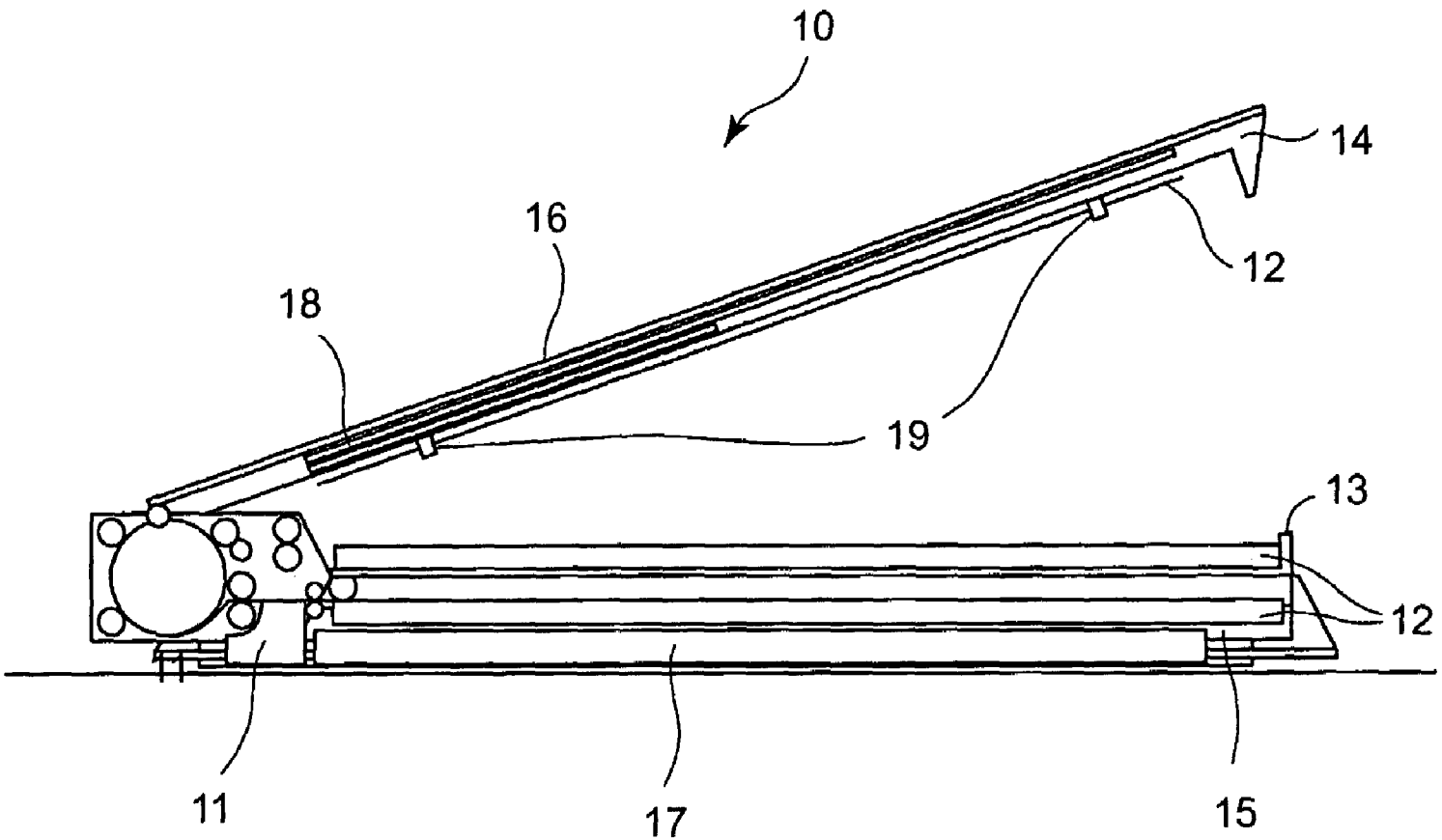
FIG. 3 is a cross-sectional view of the ink-jet printer in a state in which a cover is open.

FIG. 3 is a cross-sectional view of the ink-jet printer 10 in a state in which the cover 14 is open.

Cut sheets 12 stacked in the container 13 can be taken out by opening the cover 14, as shown in FIG. 3.

A cut sheet on which a desired image is printed is sometimes disposed in the lower part of a stack of cut sheets 12 in the container 13. Accordingly, the ink-jet printer 10 has sorting members 19 for sorting the cut sheets 12. The sorting members 19 are claws that are to be placed between stacked cut sheets. When the cover 14 is opened, the sorting members 19 hold, on the back side of the cover 14, all cut sheets stacked on a desired cut sheet sorted out. Therefore, the desired cut sheet is placed at the uppermost position when the cover 14 is opened, and can be easily taken out.

Figure 4:
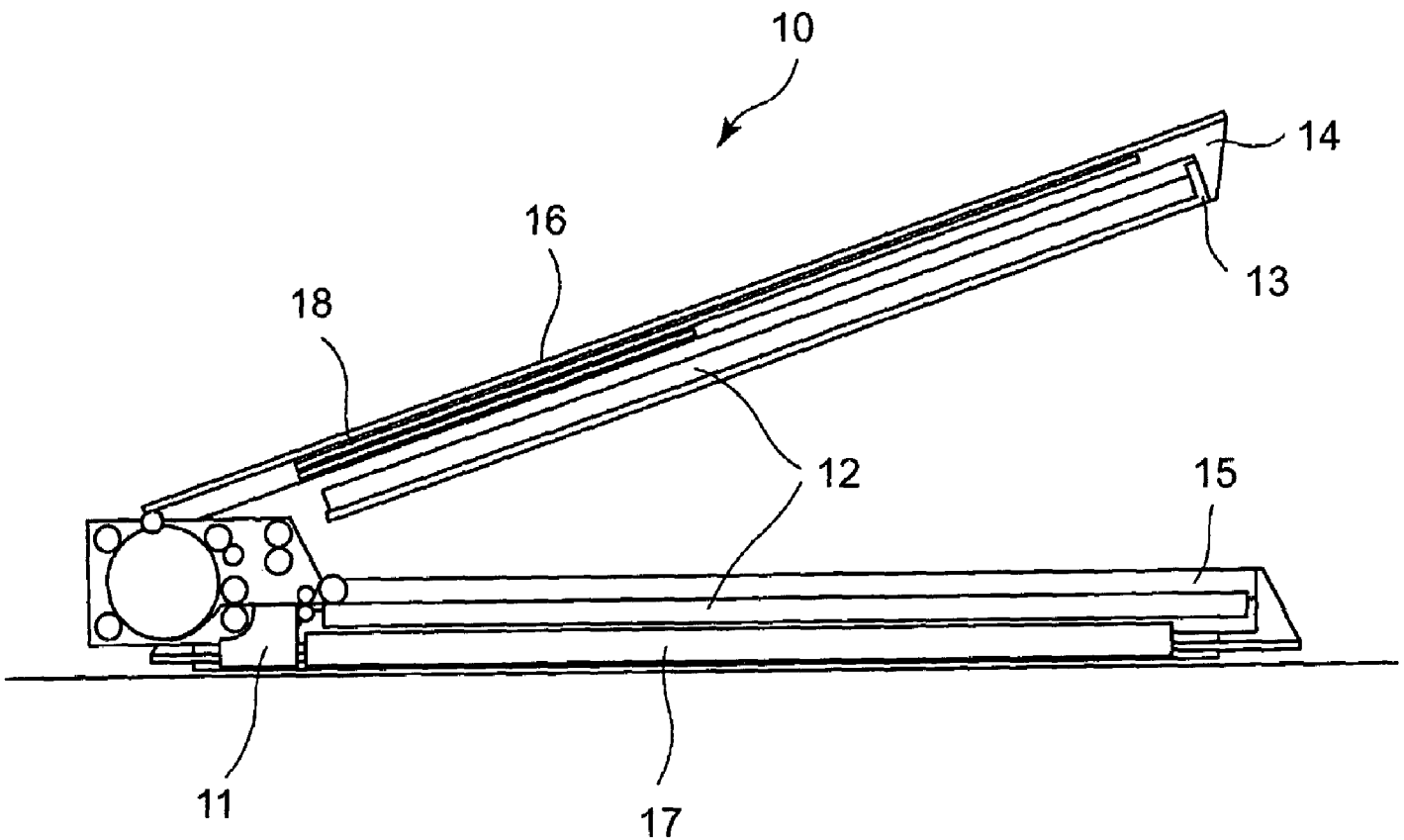
FIG. 4 is a cross-sectional view of the ink-jet printer in a state in which a container that constitutes an ejection tray is open.

FIG. 4 is a cross-sectional view of the ink-jet printer 10 in a state in which the container 13 that constitutes the ejection tray is open.

As shown in FIG. 4, the supply tray 15 and the ejection tray (container 13) placed one on the other can be separated from each other. For this reason, when the ejection tray , (container 13) is opened, cut sheets can be added into the supply tray 15.

Figure 5:
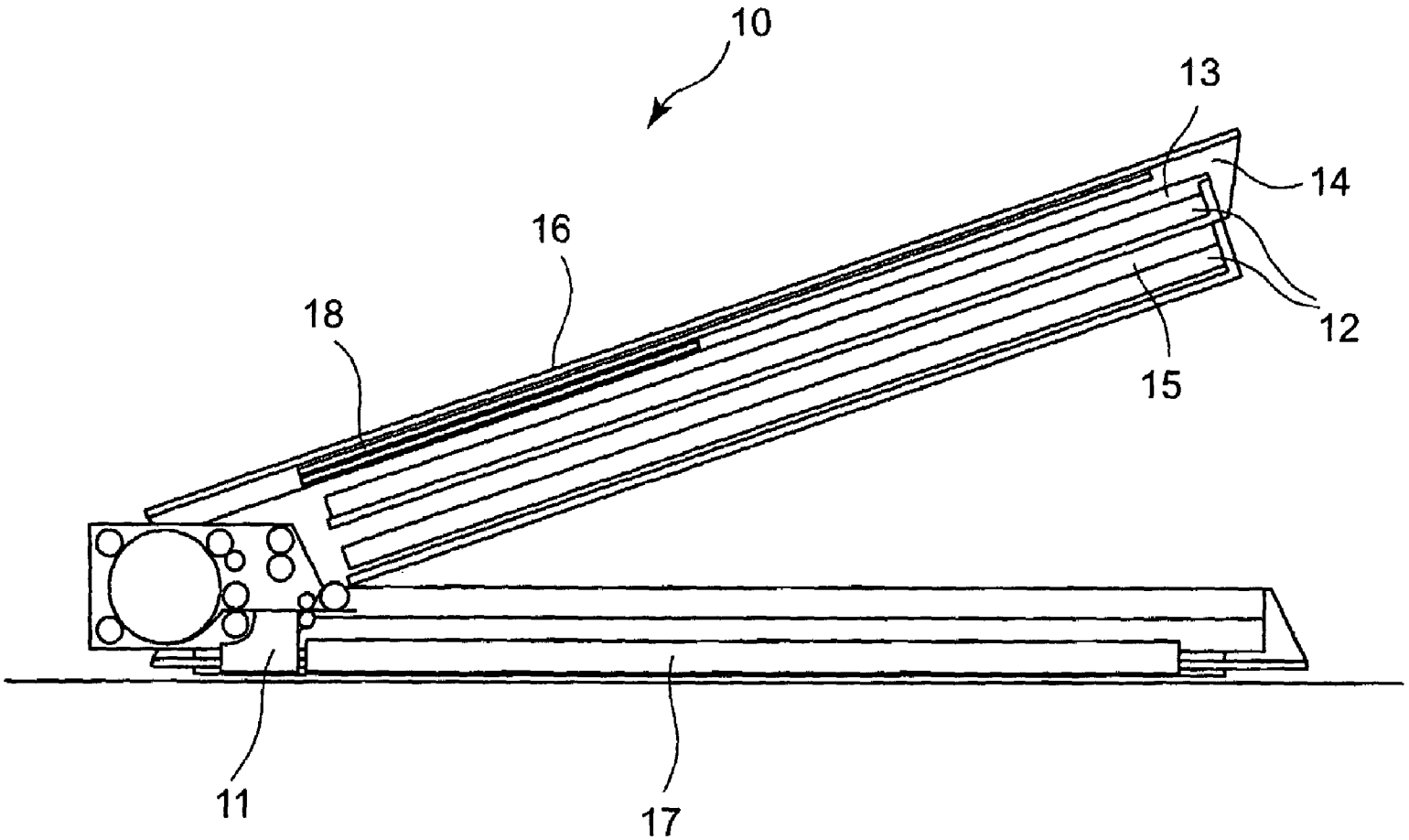
FIG. 5 is a cross-sectional view of the ink-jet printer in a state in which a supply tray for cut sheets is open.

FIG. 5 is a cross-sectional view showing a state in which the supply tray 15 is open.

As shown in FIG. 5, the supply tray 15 and the ink cartridge 17 placed one on the other can be separated from each other. For this reason, when the supply tray 15 is opened, ink can be added into the ink cartridge 17 (or the ink cartridge 17 can be replaced with another).

Figure 6:
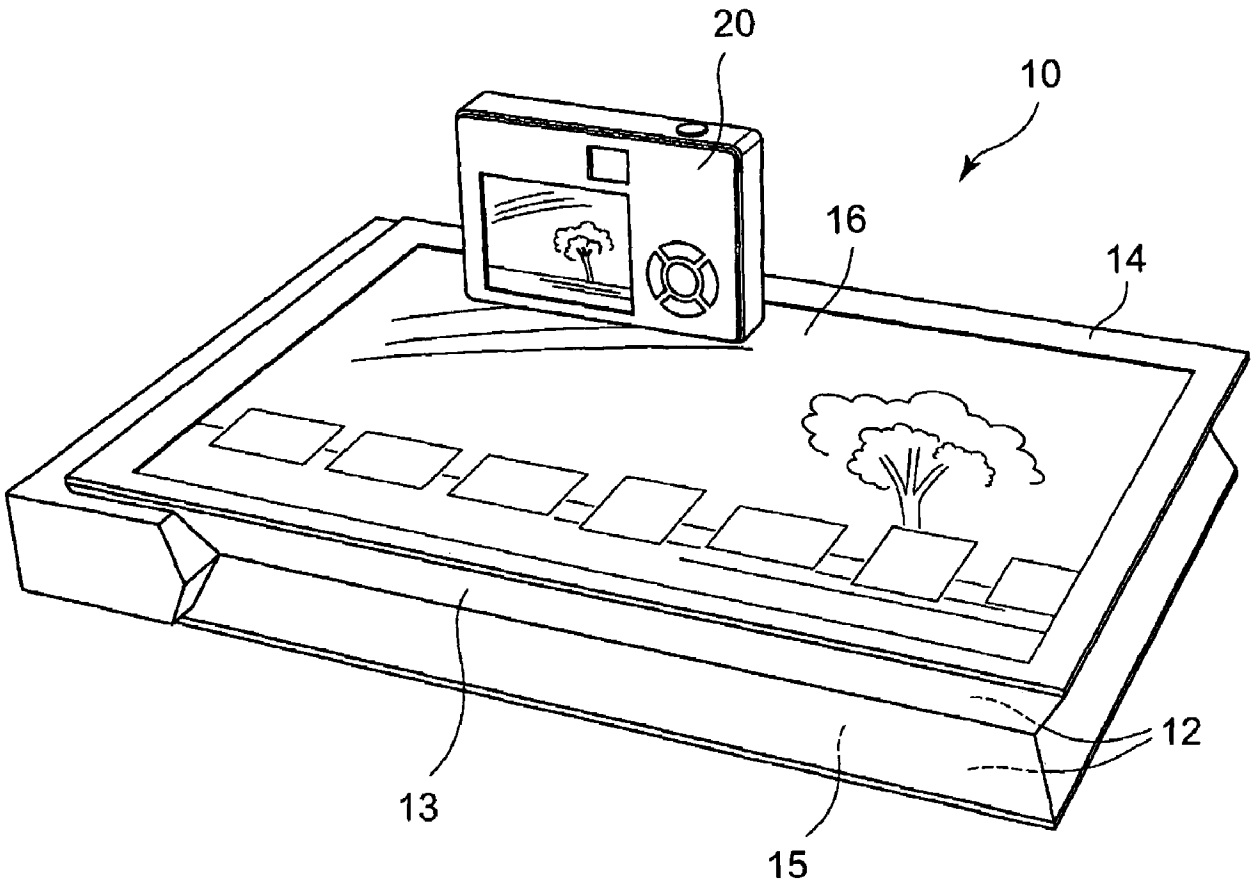
FIG. 6 is a cross-sectional view of the ink-jet printer in a state in which information is displayed on the cover.

FIG. 6 is a perspective view of the ink-jet printer 10 in a state in which information is displayed on the cover 14.

As shown in FIG. 6, the liquid crystal display 16 having a touch panel function is provided on the cover 14. Therefore, picture images are sent to the ink-jet printer 10 in a wireless manner and are stored in the memory of the ink-jet printer 10 by simply placing a digital camera 20 on the liquid crystal display 16. The digital camera 20 may be placed at any position on the liquid crystal display 16. When the digital camera 20 is placed, picture images are sent automatically.

While picture images are being sent, an image displayed on a liquid crystal display of the digital camera 20 is also displayed in a full-screen manner on the liquid crystal display 16, as shown in FIG. 6. Images that have been sent and stored in the memory of the ink-jet printer 10 are displayed on the liquid crystal display 16 in thumbnail form (enclosed by rectangles).

The images thus sent to the ink-jet printer 10 and stored in the memory can be printed on cut sheets 12 supplied from the supply tray 15. By clicking any of the thumbnail images displayed on the liquid crystal display 16 and selecting printing, printing is performed. That is, the liquid crystal display 16 displays information images corresponding to information that can be printed on the cut sheets 12. After printing, the cut sheets 12 are stacked in the container 13.

Therefore, all images that can be printed on the cut sheet 12 can be displayed on the liquid crystal display 16, and information about these images can be checked before an actual printing operation. That is, the ink-jet printer 10 also corresponds to the information display device.

In a different display mode, the liquid crystal display 16 displays information images that have been printed on the cut sheets 12 by the ink-jet head 11. That is, displayed thumbnail images correspond to images printed on the cut sheets 12. Any of the thumbnail images may be clicked so as to be selectively displayed in a full-screen manner on the liquid crystal display 16.

Figure 7:
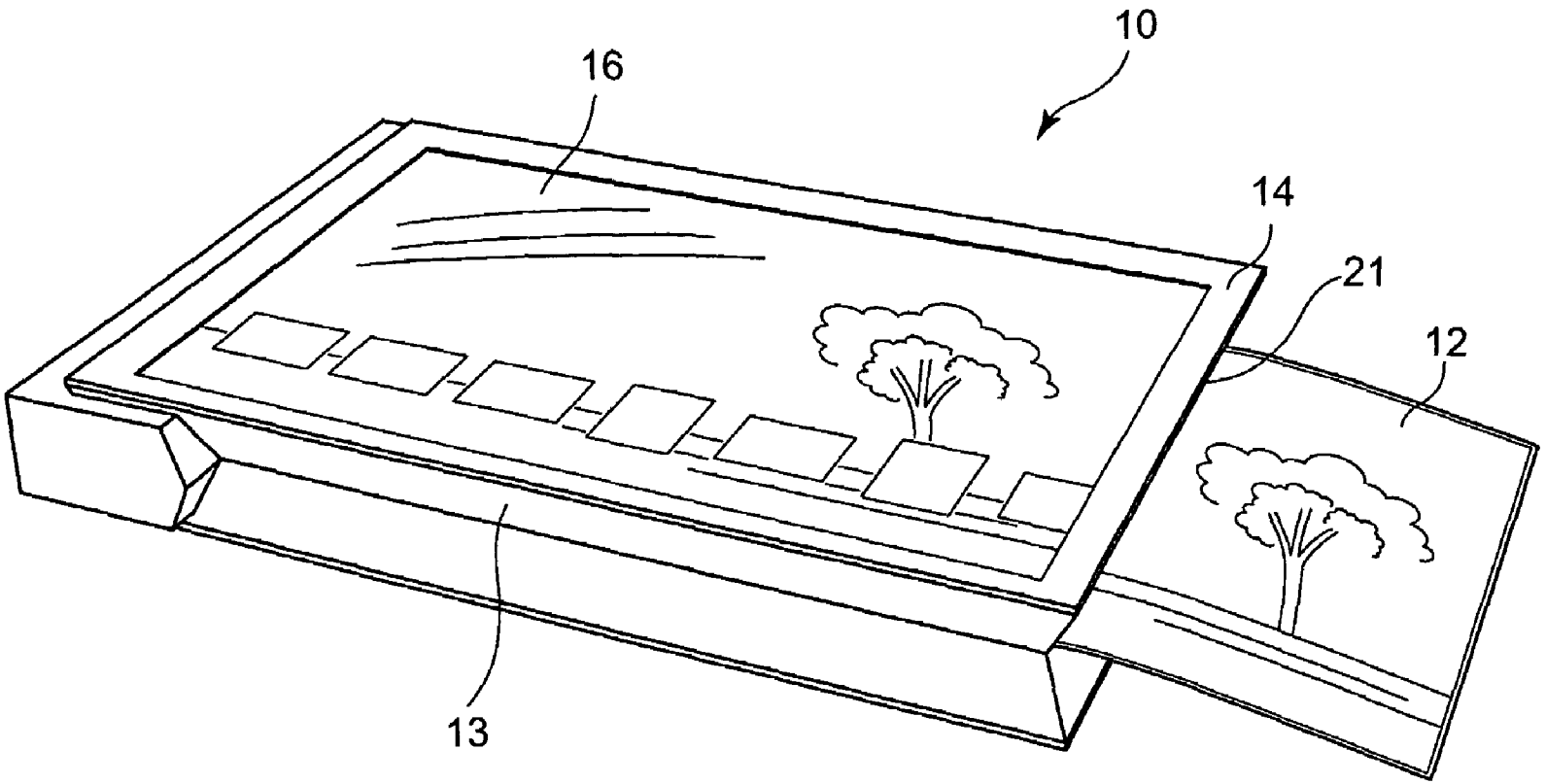
FIG. 7 is a perspective view of an ink-jet printer according to another embodiment of the present invention in a state in which a printed cut sheet is being ejected.

FIG. 7 is a perspective view of an ink-jet printer 10 according to another embodiment of the present invention in a state in which a printed cut sheet 12 is being ejected.

In an initial state, an image displayed in a full-screen manner on a liquid crystal display 16 is allowed to be inspected, as shown in FIG. 7. In this state, the image can be easily and freely replaced with another image by clicking any of thumbnail images displayed on the liquid crystal display 16 and selecting display thereof. However, the resolution of the displayed images is not necessarily sufficient.

Accordingly, for example, in order to view a favorite image with a high resolution, an image displayed on the liquid crystal display 16 is printed. For printing, any of the thumbnail images displayed on the liquid crystal display 16 is clicked. Then, the image is printed by an ink-jet head 11 (see FIG. 2), and a cut sheet 12 on which the image is printed is ejected, as shown in FIG. 7.

The printed cut sheet 12 can be taken out from a container 13 by opening a cover 14, as shown in FIG. 3. In the ink-jet printer 10 shown in FIG. 7, the printed cut sheet 12 can be automatically ejected from an ejection port 20 of the container 13 without opening the cover 14.

The ejection manner will be described in more detail. Even when a digital camera 20 (see FIG. 6) is not placed on the liquid crystal display 16, information images that can be printed on a cut sheet 12 are displayed as thumbnail images (enclosed by rectangles) on the liquid crystal display 16. When any of the thumbnail images is selected for printing by clicking, it is displayed in a full-screen manner on the liquid crystal display 16, as shown in FIG. 7.

Simultaneously, the selected thumbnail image is printed by an ink-jet head 11 (see FIG. 2), and a cut sheet 12 on which the image is printed is placed into the container 13. The printed cut sheet 12 passes through the container 13, and is automatically ejected through the ejection port 21 provided at one end of the container 13. For this reason, the printed cut sheet 12 can be taken out without opening the cover 14.

In this way, information images that can be printed on a cut sheet by the ink-jet head 11 are displayed on the liquid crystal display 16 even when the digital camera 20 is not connected to the ink-jet printer 10 of this embodiment.

Therefore, information about such images can be checked before an actual recording operation.

After information is checked and printing on a cut sheet is actually performed, the printed cut sheet can be easily taken out by simply opening the cover 14. The cut sheet can also be automatically ejected from the ejection port 21 without opening the cover 14. Consequently, a cut sheet on which a desired image is printed can be efficiently taken out.

While the embodiments of the present invention have been described above, the present invention is not limited to the embodiments, and the following modifications are possible:

(1) While the ink-jet printer 10 is described as an example of an image forming apparatus in the above embodiments, the present invention is also applicable to other image forming apparatuses such as printers, copying machines, and facsimile apparatuses.

(2) While the line-type ink-jet head 11 performs printing in the above embodiments, a serial ink-jet head may be used. Ink may be discharged by any method, for example, thermal discharging, electrostatic discharging, or piezoelectric discharging. Instead of the ink-jet head, for example, a thermal transfer head may be used for printing.

(3) While the liquid crystal display 16 serves as the display for displaying information in the above embodiments, it may be replaced with other displays such as an organic EL (electroluminescence) display. Information to be displayed is not limited to images, and may include, for example, characters.

(4) In the above embodiments, the liquid crystal display 16 having a touch panel function is used to display information, and selection from information images is made by a click operation. Alternatively, another display device having a touch panel function and an operating unit for selection from the information images may be provided separately.

According to the ejection tray, the sheet supply and ejection device, the image forming apparatus, and the information display device in the embodiments of the present invention, even when the information acquisition unit (e.g., a digital camera) for printing data is not connected thereto, information about images that can be printed on a recording sheet can be checked before an actual printing operation.

Therefore, a recording sheet on which a desired image is printed can be efficiently placed into the container. For this reason, the present invention is widely applicable to various ejection trays, sheet supply and ejection devices, image forming apparatuses, and information display devices.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus for printing an image received from a separate external image acquisition device comprising:

a housing;

an image acquisition unit in the housing for obtaining image data from said separate external image acquisition device;

a printing unit in the housing for performing printing of at least a portion of the image data on at least one recording sheet;

a supply tray in the housing for supplying the recording sheet;

an ejection tray stacked in a vertical direction above the supply tray in the housing for receiving the recording sheet supplied from the supply tray;

a cover hingedly attached to the housing wherein the cover covers the supply tray and the ejection tray; and a display provided on the cover;

wherein the display displays at least a portion of the image data obtained from the separate external image acquisition device, and which may be printed on the recording sheet; and wherein the display has a viewable surface area covering at least fifty percent or more of the housing surface area defined by its length and width dimensions and the viewable surface area of the display being greater than fifty percent of the recording sheet surface area.

2. The image forming apparatus according to claim 1, wherein the display displays the image data acquired from the separate external image acquisition device when the separate external image acquisition device is placed on or immediately over the display.

3. The image forming apparatus according to claim 1, further comprising:

an image holding unit for holding the image data acquired from the separate external image acquisition device, wherein the display displays at least a portion of the image data held by the image holding unit.

4. The image forming apparatus according to claim 1, wherein the display has a touch panel function.

5. The image forming apparatus according to claim 1, wherein a recording sheet path is provided from the supply tray through the printing unit to the ejection tray.

6. The image forming apparatus according to claim 1, wherein the image acquisition unit obtains the image data from said separate external image acquisition device via a wireless signal.

7. The image forming apparatus according to claim 1, further comprising an ink jet print head for printing the image data on the recording sheet.

* * * * *